United States Patent [19]

Seebacher

[11] 4,131,692

[45] Dec. 26, 1978

[54] METHOD FOR MAKING CERAMIC ELECTRIC RESISTOR

[75] Inventor: Baerbel Seebacher, Munich, Germany

[73] Assignee: Siemens Aktiengesellschaft, Berlin & Munich, Germany

[21] Appl. No.: 713,355

[22] Filed: Aug. 11, 1976

Related U.S. Application Data

[62] Division of Ser. No. 592,524, Jul. 2, 1975, abandoned.

[30] Foreign Application Priority Data

Jul. 11, 1974 [DE] Fed. Rep. of Germany ..... 2433458

[51] Int. Cl.[2] ..... C23C 3/02

[52] U.S. Cl. ..... 427/101; 427/102; 427/98; 427/92; 427/304; 427/305; 427/314; 427/383 B

[58] Field of Search ..... 427/102, 101, 305, 98, 427/92, 304, 306, 314, 383 B

[56] References Cited

U.S. PATENT DOCUMENTS

| | | | |
|---|---|---|---|
| 3,414,427 | 12/1968 | Levy | 427/314 |
| 3,555,376 | 1/1971 | Nitta et al. | 357/67 |
| 3,567,508 | 3/1971 | Cox et al. | 357/67 |
| 3,588,636 | 1/1971 | Giesfeldt | 357/10 |
| 3,607,389 | 9/1971 | Canegallo | 427/305 |
| 3,645,785 | 2/1972 | Heutzschel | 357/71 |
| 3,694,250 | 9/1972 | Grunwald | 427/305 |
| 3,829,303 | 8/1974 | Zeto et al. | 252/63.2 |
| 3,932,694 | 1/1976 | Hamaguchi et al. | 427/305 |
| 3,963,841 | 6/1976 | Anschel et al. | 427/305 |

*Primary Examiner*—Ralph S. Kendall
*Assistant Examiner*—John D. Smith
*Attorney, Agent, or Firm*—Hill, Gross, Simpson, Van Santen, Steadman, Chiara & Simpson

[57] ABSTRACT

A ceramic electric resistor and a method for making the same. The resistor has a body which is formed of a material having a Perovskite structure with semiconducting doping and on its surface is contacted with two layers of different materials. The first layer is palladium or in association with palladium chloride and the second layer is one from a group of nickel, nickel-phosphorus or nickel-boron alloys. The process includes stoving-in the palladium or palladium chloride solution and providing a given composition of nickel bath for the second layer.

7 Claims, 1 Drawing Figure

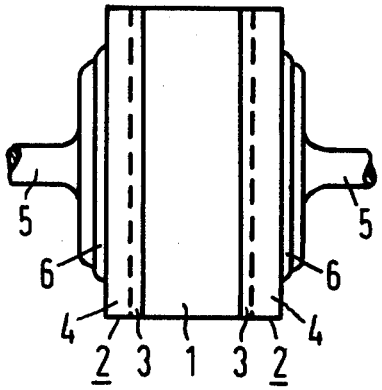
5
5
6
6
4
4
2
3
1
3
2

METHOD FOR MAKING CERAMIC ELECTRIC RESISTOR

This is a division of application Ser. No. 592,524, filed July 2, 1975 now abandoned.

BACKGROUND OF THE INVENTION

Description of the Prior Art

The German Pat. No. 1,490,713 discloses a cold conductor with contact means which are free of blocking layers wherein the contact means comprise two layers of different materials. On the surface of the cold conductor at the points to be contacted there is arranged an indium or indium-gallium layer and upon the latter is arranged a layer of stoving silver preparation which is stoved in an oxidizing atmosphere. The difficulties involved in the production of this known cold conductor is that the two process steps for the production of the contact platings must be very carefully adapted to one another if it is to be certain that the values for the bonding strength and the freedom of blockages are to be reproducible. In addition, the process for the production of the cold conductor is difficult to automate and the contact platings consist of expensive materials.

U.S. Pat. No. 3,586,534 also discloses contact means of cold conductors which are free of blocking layers. In this case, the surfaces which are to be metallized are sensitized and activated, and then a currentless deposition of a nickel-phosphorus alloy is effected. The sensitization is effected by submerging the cold conductors in a tin (II)-chloride solution and then activation is effected by submerging in a palladium (II) - chloride solution. Currentless deposition of a nickel-phosphorus alloy is made upon the sensitized and activated surface in a bath which contains nickel (II) - chloride, sodium hypophosphite as reduction agent and sodium citrate as stabilization agent. The difficulties involved in the production of these contacts is that prior to submerging the cold conductor bodies in the sensitization bath, it is necessary to cover those surface parts where no contact plating is to be provided. Also, by this method it is difficult to dose the palladium chloride which adheres to the surface and which determines the bonding strength of the nickel-phosphorus layer. In addition, the danger exists that the palladium chloride will enter and decompose the nickel bath.

SUMMARY OF THE INVENTION

It is an important feature of the present invention to provide an improved ceramic electric resistor.

It is another feature of the present invention to provide a ceramic electric resistor having a semiconductor body and being contacted with two layers formed of palladium or in association with palladium chloride and nickel or nickel-phosphorus or nickel-boron alloys.

It is another feature of the present invention to provide a ceramic electric resistor of the type described above wherein the thickness of the first and second contact layers are predetermined values.

It is another feature of the present invention to provide a process for the production of a resistor as described above wherein the palladium or palladium chloride solution is applied to the surface of the ceramic body and stoved-in at predetermined temperatures for predetermined time intervals and wherein the second layer is formed by plating in a nickel bath of given composition. These and other objects, features and advantages of the present invention will be understood in greater detail from the following description and associated drawing wherein reference numerals are utilized to designate a preferred embodiment.

A BRIEF DESCRIPTION OF THE DRAWING

The single FIGURE in the present application shows a ceramic electric resistor according to the present invention, however, the various layers of the resistor are not necessarily proportioned according to their given thicknesses to improve the illustration.

DESCRIPTION OF THE PREFERRED EMBODIMENT

The invention relates to a ceramic electric resistor with a positive temperature coefficient of resistance which is referred to herein as a cold conductor. The cold conductor body is stoved in an oxidizing atmosphere and consists of a material which is of a Peronskite structure and is semiconducting (n-conducting) as a result of doping with alien-lattice ions. This body is provided on its surface with contact platings which are free of blocking layers and which consist of two layers of different materials to which an outer contact plating is in each case soldered, and the invention further relates to a process for the production of this device.

Ferroelectric materials which possess a Peronskite structure are e.g. the titanates and/or stannates and/or zirconates of the alkaline earth metals with and without lead additives. Antimony, niobium, bismuth or rare earths are used for example as doping substances for the production of the semiconductor.

The aim of the present invention is to provide a cold conductor and a process for the production thereof in which the difficulties of the prior art are avoided. In particular the aim of the present invention is to provide a cold conductor which can be produced economically and which possesses a solderable contact plating which is free of blocking layers and exhibits an increased bonding strength.

This aim is realized in a cold conductor where the first layer which covers the surface of the ceramic body at the points which are to be contacted consists of palladium alone or in conjunction with palladium chloride, and that the second layer which is arranged on the first layer consists of nickel or a nickel-phosphorus or a nickel-boron alloy.

The aim to provide a process for the production of a cold conductor is realized in accordance with the invention in that a palladium (II) - chloride solution is applied to and stoved into the surface at the points to be contacted, and that subsequently a currentless nickel-plating of the first layer is effected, and that the resistors are then tempered.

The advantages of the invention are that no sensitization of the surface is effected, and that at the same time the deposition speed of the second layer is substantially increased. whereby the reproducibility of the blocking-layer-free contacting is improved. The ususal processes suitable for the application of metal preparations, such as painting, rolling, spraying or silk-screen printing can be used to apply the activation substance ($PdCl_2$), and it is possible to form desired insulation zones. Preferably a 0.01 to 0.2% $PdCl_2$ solution is used which is stoved in at temperatures of between 300° and 550° C. in 10 to 60 minutes.

This produces a layer thickness of the first layer of approximately 0.2 to 50 nm. in dependence upon the concentration used. In dependence upon the stoving-in temperature, a layer of palladium alone or of palladium in association with non-decomposed palladium chloride (decomposition temperature of $PdCl_2$ approximately 500° C.) will form. At stoving-in temperatures less than 300° C. the palladium is not held sufficiently firm on the surface of the cold conductor so that it passes into the nickel bath which it can cause to decompose. At higher temperatures than 550° C. the hot resistance can be reduced i.e. the resistance ratio at the "leap temperature" of the cold conductor is undesirably reduced.

The quoted concentration values of the palladium chloride bath and the quoted stoving temperatures proved favorable in the case of cold conductors consisting of barium titanate and barium-lead-titanate. These values could also be used however for cold conductors consisting of other materials.

Nickel baths known from the metallization of synthetics can be used for the production of the second layer, and in dependence upon the composition of the bath either nickel-phosphorus or nicke-boron alloys will be obtained.

In an exemplary embodiment, cold conductors consisting of barium titanate and barium-lead-titanate were coated with 0.01 to 0.2% $PdCl_2$ solutions and stoved at temperatures of 300° to 550° C. The subsequent nickel-plating was carried out in a bath of similar composition to that described in the U.S. Pat. No. 3,586,534. The bath contained the following:

3% by weight $NiCl_2 . 6H_2O$
1% by weight $NaH_2PO_2 . H_2O$ 3 to 7% by weight $Na_3C_6H_5O_7 . 2H_2O$ and 89 to 93% by weight water.

Bath temperatures of between 65 and 95° C. were used. The deposition times amounting to between 1 to 60 minutes. The deposition time depended upon the surface of the cold conductor. the palladium concentration, the bath temperature and the citrate content of the bath. The lower the bath temperature, the more resistant is the bath but the longer are the periods of dwell in the bath.

Subsequently, the samples were well flushed and tempered at temperatures of between 200 and 300° C. for 2 to 15 hours. Tempering carried out at higher temperatures produced layers which were difficult to tinplate.

To check the tear-off resistance, the samples were dip-tinned with a solder of the composition 60% tin, 36% lead and 4% silver, and copper wires were soldered to them. It was also possible to solder the copper wires directly onto the nickel surfaces.

In the case of the barium titanate cold conductors, tear-off resistances of approximately 70 N were achieved, and in the barium-lead-titanate cold conductors, tear-off resistances of approximately 60 N were achieved. The soldering surface possessed a diameter of 4 mm. The values obtained for the tear-off resistance correspond to the strength of the ceramic.

The single FIGURE of the drawing in this application illustrates a cold conductor of the type described above. Arranged on the ceramic body 1 are the contact platings 2 which consist of a first layer 3 of palladium and palladium chloride and of a second layer 4 of a nickel-phosphorus or nickel-boron alloy. The outer contact elements 5 are soldered to the contact platings 2 by means of a solder 6. For clarity the proportions have been exaggerated in the FIGURE.

I claim as my invention:

1. A process for the production of a ceramic electric resistor comprising:

the steps of obtaining a ceramic body which consists of material having a Peronskite structure with semiconducting doping with alien-lattice ions, applying a palladium (II)-chloride solution to the surface of the ceramic body at points to be contacted, stoving in the palladium (II)-chloride solution at temperatures between 300° to 500° C. after it has been applied to the ceramic body, currentless nickel-plating the resulting palladium (II)-chloride layer to produce a second layer and tempering the resulting resistor.

2. A process in accordance with claim 1 wherein a 0.01 to 0.2% by weight $PdCl_2$ solution is used to produce the first layer.

3. A process in accordance with claim 2 wherein the first layer is stoved-in at temperatures of between 300° and 550° C. or 10 to 60 minutes.

4. A process in accordance with claim 1 wherein a nickel bath of the following composition is used for the production of the second layer:

3% by weight $NiCl_2 . 6H_2O$
1% by weight $NaH_2PO_2 . H_2O$
3 to 7% by weight $Na_3C_6H_5O_7 . 2H_2O$
89 to 93% by weight $H_2O$.

5. A process in accordance with claim 4 wherein the currentless nickel-plating is carried out at bath temperatures of 65° to 95° C. during 1 to 60 minutes.

6. A process in accordance with claim 5 wherein the tempering is carried out at temperatures from 200° to 300° C. in 2 to 15 hours.

7. Method for producing a ceramic electric resistor having a positive temperature coefficient of resistance and including an oxidizing stoved body consisting of a material possessing Perovskite structure and being semiconducting by means of doping with alien-lattice ions, said body being provided with contact platings free of blocking layers, said contact platings including at least two layers of different materials, the first of said two layers being of palladium and the second layer situated on the first layer being of a nickel-phosphorous alloy including the steps of applying a palladium (II) chloride solution with 0.01 to 0.2% by weight $PdCl_2$ to the surface of the ceramic body at areas to be contacted, stoving the palladium (II) chloride layer at temperatures between 300° C. and 550° C. for a time between 10 and 60 minutes, immersing the resulting stoved layer in a nickel bath having the following composition:

3% by weight $NiCl_2 . 6H_2O$
1% by weight $NaH_2PO_2 . H_2O$
3–7% by weight $Na_3C_6H_5O_7 . 2H_2O$
currentless nickel plating in said bath at temperatures of 65° C. to 95° C. for a time between 1 and 60 minutes, and tempering the resulting resistor for 2 to 15 hours at temperatures from 200° C. to 300° C.

* * * * *